US006099441A

United States Patent [19]

Bonnet

[11] Patent Number: 6,099,441

[45] Date of Patent: Aug. 8, 2000

[54] WATER WEIGHT EXERCISE KIT

[76] Inventor: Darrell B. Bonnet, 208 W. Third, Del Rio, Tex. 78840

[21] Appl. No.: 09/220,764

[22] Filed: Dec. 28, 1998

[51] Int. Cl.[7] ..... A63B 21/75

[52] U.S. Cl. ..... 482/93; 482/106; 482/108

[58] Field of Search ..... 482/93, 106, 108, 482/910; 215/900; 220/666

[56] References Cited

U.S. PATENT DOCUMENTS

| | | | |
|---|---|---|---|
| D. 297,961 | 10/1988 | Egger . | |
| 3,781,007 | 12/1973 | Baker et al. | 482/106 |
| 4,103,887 | 8/1978 | Shoofler | 482/106 |
| 4,651,988 | 3/1987 | Sobel . | |
| 4,690,399 | 9/1987 | Hayashi . | |
| 4,695,051 | 9/1987 | Jenison . | |
| 4,854,575 | 8/1989 | Wilson et al. . | |
| 4,949,955 | 8/1990 | Keen . | |
| 5,037,087 | 8/1991 | Roth . | |
| 5,056,778 | 10/1991 | Hull et al. . | |
| 5,174,458 | 12/1992 | Segati | 220/666 |
| 5,431,615 | 7/1995 | Correll . | |
| 5,445,587 | 8/1995 | Brown . | |
| 5,580,343 | 12/1996 | Cafiero . | |

*Primary Examiner*—John Mulcahy

[57] ABSTRACT

The water weight exercise kit includes two weights, a funnel for filling the weights with water, and a storage pouch. Both of the weights are bags or bladders made from a strong, flexible thermoplastic material and have a fill spout through which the weights may be filled with water for use and drained after use. One of the weights is a barbell-like weight, having the capacity for receiving about fifty pounds of water and having a handle with a neoprene grip which extends from both sides of the top of the weight. The second weight is a dumbbell-like weight, having the capacity for receiving about ten pounds of water and having a handle with a neoprene grip at the top of the weight. The funnel is a clear flexible plastic hose having a clear, flexible conical spout, the hose being adapted for insertion into the fill spouts of the weights. The kit further includes a nylon storage pouch having a drawstring, so that the weights may be rolled up around their handles after use and placed in the pouch with the funnel for storage or transport.

20 Claims, 5 Drawing Sheets

WATER WEIGHT EXERCISE KIT

BACKGROUND OF THE INVENTION

1. Field of the Invention

The present invention relates to exercise apparatus, and particularly to a portable exercise kit having weight lifting devices in which the weight is supplied by water.

2. Description of the Related Art

Exercise is generally recommended as an important component of physical fitness program. While isometric exercises (contraction of a muscle against an immovable object, producing tension without motion) have their merits, isotonic exercises (exercise with movement) are recognized as improving the cardiovascular and circulatory systems. It has been found that the value of isotonic exercise is greatly enhanced. It has further been thought that certain forms of isotonic exercise, particularly weight lifting, increases muscle size more rapidly than isometric exercise.

There are, however, certain impediments to maintaining a program of weight lifting. First, a standard set of weights is expensive. Second, a standard set of weights can require considerable storage space. For these reasons, some people prefer to go to a gym to work out with weight lifting equipment. However, many people find gyms and health club memberships too expensive and beyond their means, economically. Third, exercise should be repeated regularly to obtain maximum value. Many people travel in the course of their occupation, and it is simply impractical to transport a set of weights with them on business trips.

Consequently, it is desirable to provide alternative forms of weights which might be used for weight lifting exercises which are economical and portable. A number of devices have been developed which utilize containers that may be filled with water or other dense, flowable materials as substitutes for standard weights.

U.S. Des. Pat. No. 297,961, issued Oct. 4, 1988 to W. J. Eggar, shows what appears to be a rigid bottle with a rectangular hole and a hand grip defined therein and having a removable cap so that it may be filled with water or other flowable material. U.S. Pat. No. 4,695,051, issued Sep. 22,1987 to R. E. Jenison, teaches a dumbbell like device in the form of a bladder having a cylindrical handle and enlarged end pieces, the end pieces having a removable cap for filling the bladder with liquid. U.S. Pat. No. 4,651,988, issued Mar. 24, 1987 to D. D. Sobel, describes a device adapted to use aluminum cans as a handheld exercise device. The device is a C-shaped handle with a head portion having a cylindrical recess for receiving the top of the can, and a foot portion for receiving the lip on the bottom of an aluminum can.

U.S. Pat. No. 4,690,399, issued Sep. 1, 1987 to S. Hayashi, discloses a flexible dumbbell for use in running having a cylindrical body of elastic material with end caps and an inner core having metal discs arranged longitudinally or having a metal powder so that the cylindrical body is flexible. U.S. Pat. No. 4,854,575, issued Aug. 8, 1989 to Wilson, et al., shows a doughnut shaped ring of a collapsible thermoplastic material with a handle going across the inside diameter of the doughnut, being fillable with water or sand. The edges of the ring have accordion type pleats.

U.S. Pat. No. 4,949,955, issued Aug. 21, 1990 to R. Keen, shows a weight tube with a handle and handle grips, the tube being filled with a high density flowable substance such as water. The weight tube is between five and ten feet long, preferably as long as the height of the exerciser with his arms raised. The weight tube is also quite narrow so that it remains flexible, even after being filled with water, the device being designed on the Nautilus principle so that a substantial portion of the tube remains on the ground, the mass of water being gradually increased as the tube is lifted. U.S. Pat. No. 5,037,087, issued Aug. 6, 1991 to P. Roth, describes a bottle filled with water connected to a cylindrical roll bar by a rope, the roll bar being rotated to raise and lower the bottle for wrist exercise.

U.S. Pat. No. 5,056,778, issued Oct. 15, 1991 to Hull, et al., discloses a dumbbell device with two chambers interconnected by a passageway in a cylindrical handle, the device being partially filled with water to the water may be shifted from one side to the other for rotational stress exercises. The device includes hook and loop fastener straps for attaching the dumbbell to a shoe. U.S. Pat. No. 5,431,615, issued Jul. 11, 1995 to C. D. Correll, shows two bottles with threaded necks connected by a double-ended threaded connector, glitter and foam pellets being placed in water in the bottles for decorative effect.

U.S. Pat. No. 5,445,587, issued Aug. 29, 1995 to L. Brown, teaches a dumbbell with a handle and two end chambers, the device including sight windows in the handle and chambers to view the quantity of liquid in the device. Optionally, the chambers may contain bladders. U.S. Pat. No. 5,580,343, issued Dec. 3, 1996 to H. A. Cafiero, describes a "refillable dumbbell" device for holding a liquid filled bottle, including an upper bottle holder portion, a cup-like lower bottle holder portion, and a handle tensioner device between the two portions.

The devices disclosed in the foregoing patents describe weights adapted for particular applications, either exclusively for single hand dumbbell exercises or for lifting with both hands. The kit of the present invention provides both a single handed device and a weight for lifting with both hands. Further, the devices shown in the foregoing patents do not include a carrying case or storage case to prevent accidental leakage of unevaporated fluids, nor do they teach a means for filling the device with liquid. The kit of the present invention includes a convenient storage case and a funnel adapted for filling the weights with water. Furthermore, many of the above devices provide for a symmetrical distribution of the weight, in the case of a dumbbell, with enlarged chambers on opposite sides of the handle, or in the case of a barbell, with enlarged chambers on opposite ends of the bar outside the hand grips. The weights included in the kit of the present invention concentrate the weight beneath the handle in the single hand device, and between the hand grips on the heavier weight.

None of the above inventions and patents, taken either singularly or in combination, is seen to describe the instant invention as claimed. Thus a water weight exercise kit solving the aforementioned problems is desired.

SUMMARY OF THE INVENTION

The water weight exercise kit includes two weights, a funnel for filling the weights with water, and a storage pouch. Both of the weights are bags or bladders made from a strong, flexible thermoplastic material and have a fill spout through which the weights may be filled with water for use and drained after use. One of the weights is a barbell-like weight, having the capacity for receiving about fifty pounds of water and having a handle with a neoprene grip which extends from both sides of the top of the weight. The second weight is a dumbbell-like weight, having the capacity for receiving about ten pounds of water and having a handle with a neoprene grip at the top of the weight. The funnel is a clear flexible plastic hose having a clear, flexible conical spout, the hose being adapted for insertion into the fill spouts of the weights. The kit further includes a nylon storage pouch having a drawstring, so that the weights may be rolled up around their handles after use and placed in the pouch with the funnel for storage or transport.

Accordingly, it is a principal object of the invention to provide an exercise kit having a small weight adapted for lifting by one hand, and a larger weight adapted for lifting with both hands, the kit being portable by making the weights from flexible plastic bags or bladders which maybe filled with water.

It is another object of the invention to provide a water weight exercise kit having means for filling the weights with water by including a funnel of flexible plastic hose.

It is a further object of the invention to enhance the portability and convenience of a water weight exercise kit by providing the kit with a nylon storage pouch.

Still another object of the invention is to provide an isotonic weight lifting kit which is economical and easy to manufacture by providing weights made from thermoplastic containers fillable with water and stored in a nylon pouch.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
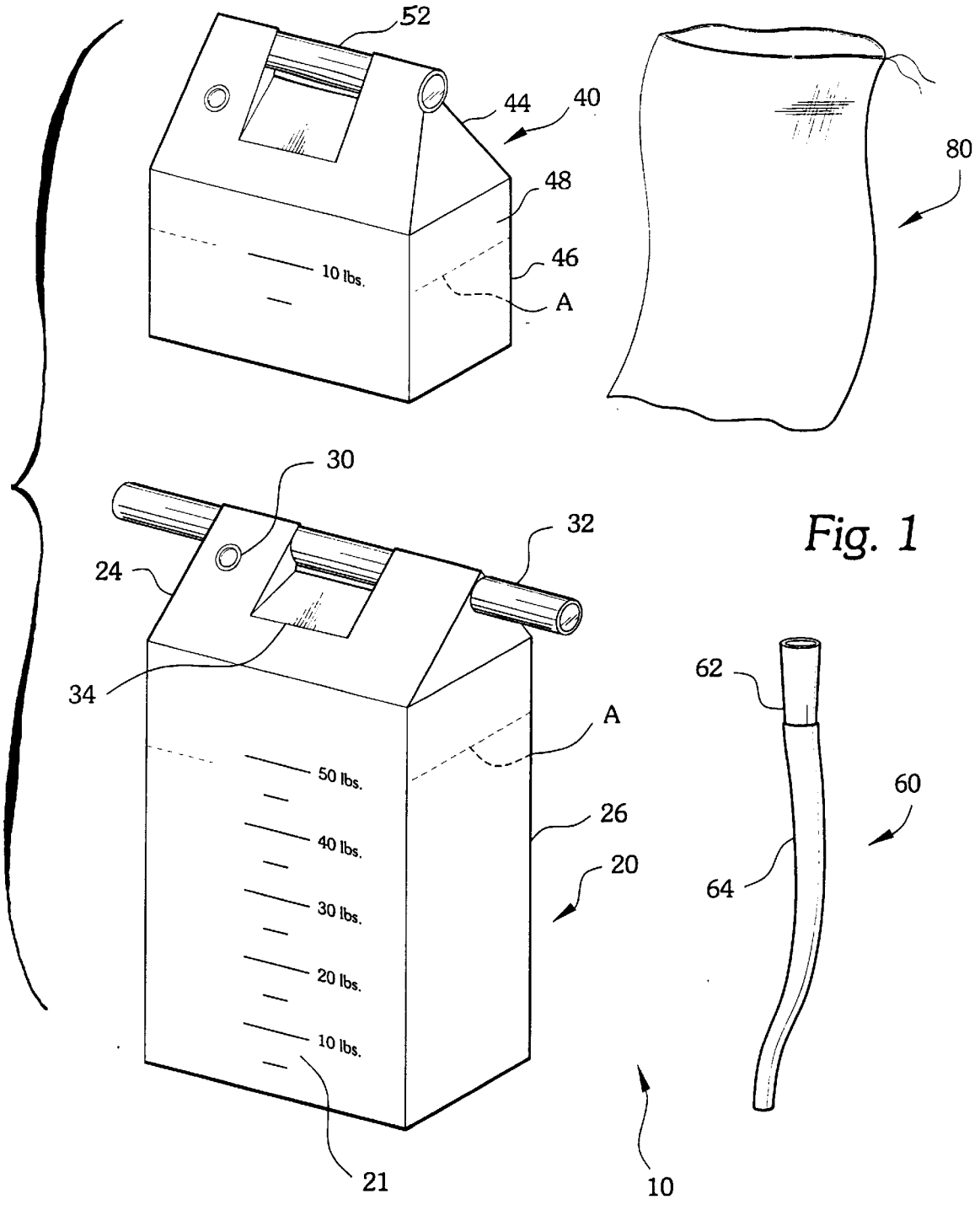
FIG. 1 is an perspective view of a water weight exercise kit according to the present invention.

The present invention is a water weight exercise kit, designated as 10 in the drawings. FIG. 1 shows the components of the kit 10, which include the kit's version of a barbell 20 type and a dumbbell 40 type weight, a funnel 60 for use in filling the weights with water, and a storage pouch 80 for storing and transporting the kit 10 when not in use.

Figure 2:
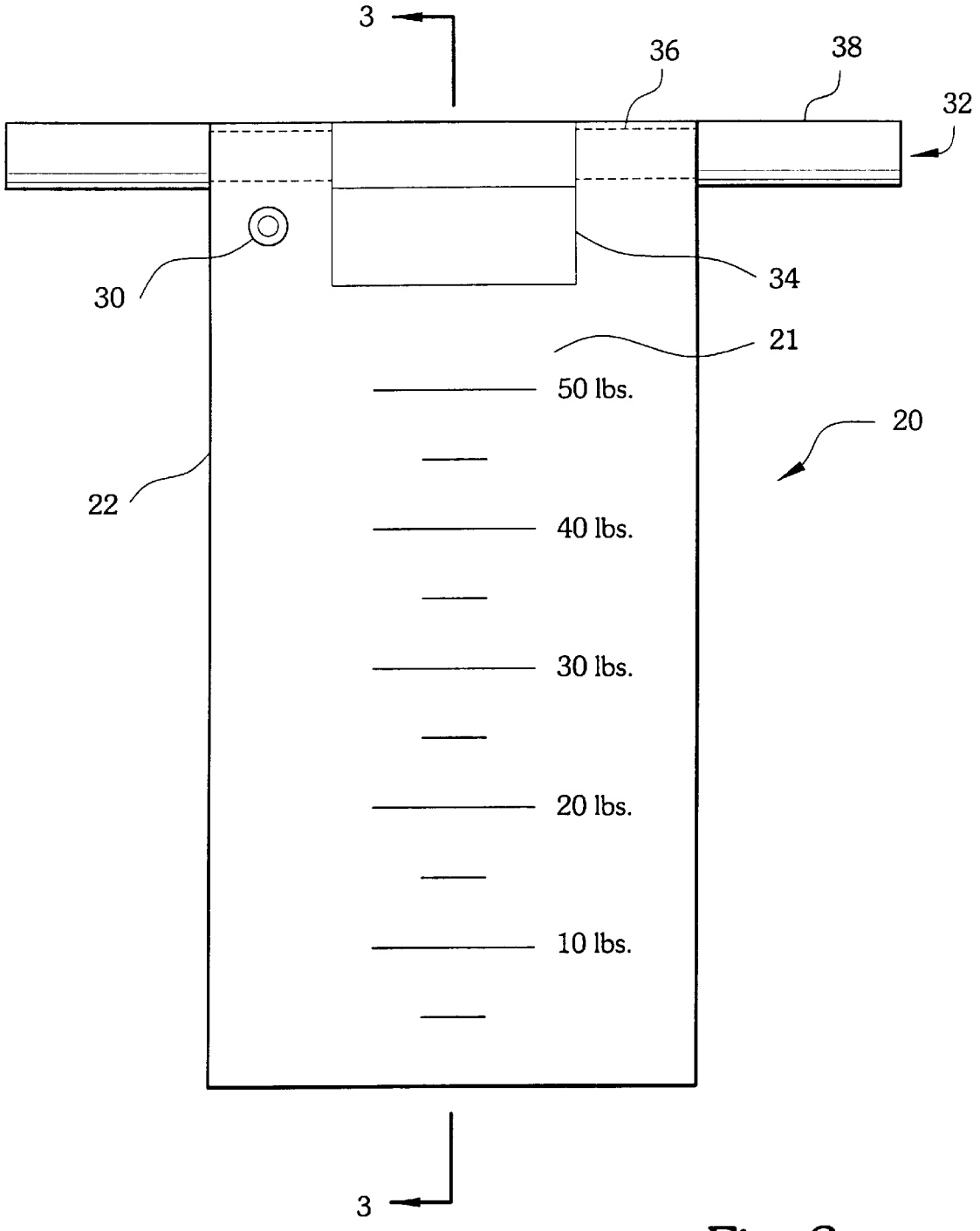
FIG. 2 is a front elevational view of a barbell weight of the water weight exercise kit according to the present invention.
Figure 3:
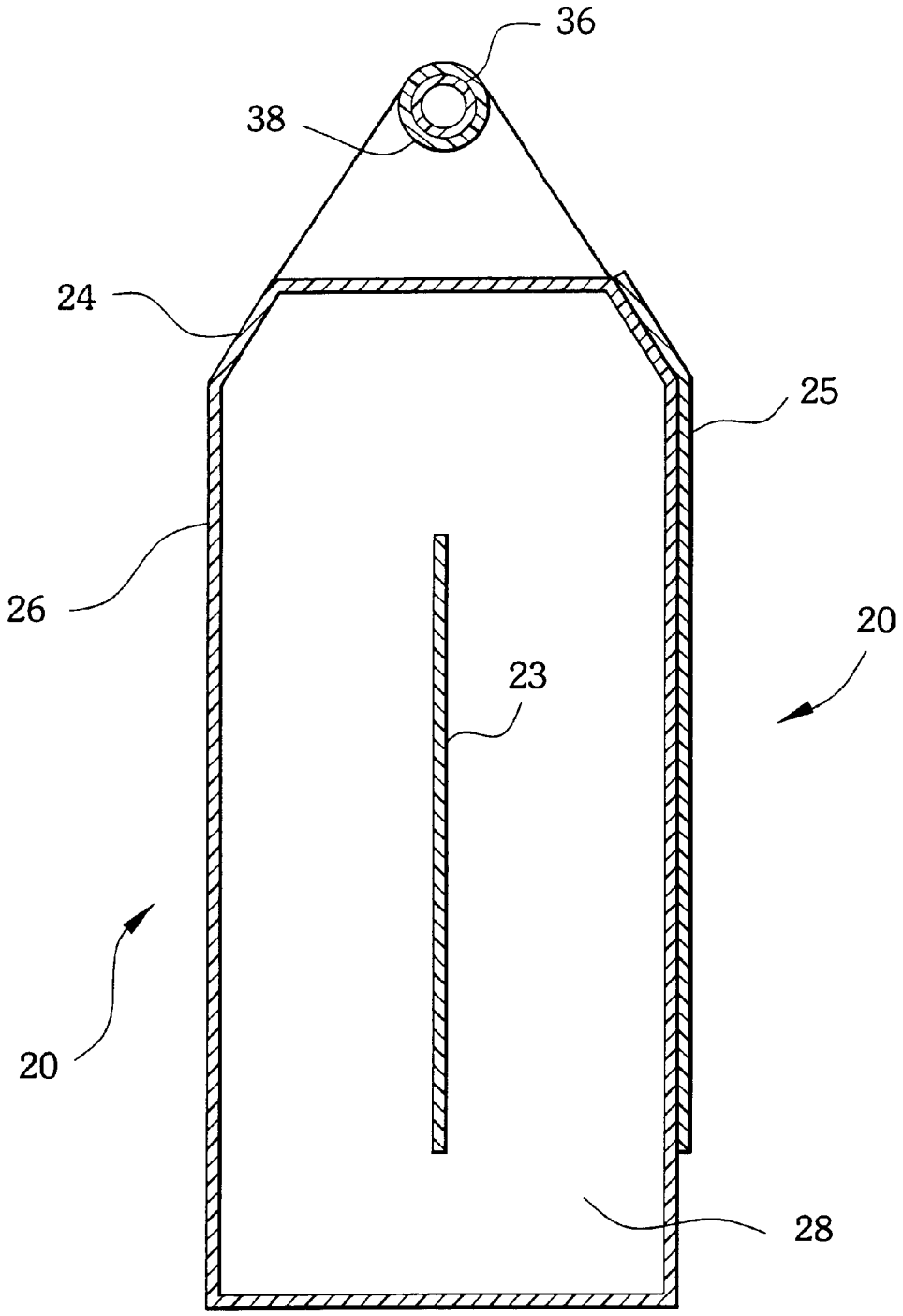
FIG. 3 is a section view along the line 3–3 of FIG. 2.

As shown in FIGS. 1, 2, and 3, the barbell 20 type weight includes a strong, flexible bag 22 or bladder made from a thermoplastic material, such as polypropylene. The bag 22 includes an upper portion 24 and a lower portion 26, the interior of the bag 22 forming an enclosed, water-tight chamber 28 adapted for receiving water through a fill spout 30 disposed on the upper portion of the bag 22. As shown in FIG. 1, when the bag 22 is filled with water A and suspended by a user (not shown) during a normal exercise program, the lower portion 26 is shaped like a rectangular prism and the upper portion 24 is shaped like a triangular prism so that the bag 22 bears a resemblance to a building having a gable roof as viewed from the side.

The bag 22 includes a cylindrical handle 32 disposed in the upper portion 24, the ends of the handle 32 extending from both sides of the bag 22, the longitudinal axis of the cylindrical handle 32 being aligned with the centerline of the bag 22, which extends along the apex of the upper portion 24. The upper portion 24 has a recess 34 defined in its central portion, the recess 34 also having the shape of a triangular prism, the recess 34 permitting the user to have the option of gripping the handle 32 with two hands grasping opposite ends of the handle 32 so that the weight is suspended between the user's hands, or the option of gripping the handle 32 with one hand disposed about the central portion of the handle 32, the weight being suspended directly below the user's hand.

As shown most clearly in FIG. 3, the handle 32 is made from a hollow pipe 36 of plastic material, such as polyvinyl chloride. A hand grip 38 made from neoprene is disposed about the pipe 36. The bag 22 is made from a flexible material, so that when the bag 22 is empty, it may be rolled around the handle 32 for storage. The chamber 28 has the capacity to receive at least fifty pounds of water A. In the preferred embodiment, the bag 22 is made from a translucent material and has indicia 21 on its surface calibrating the volume of the chamber 28 in convenient increments, such as every five to ten pounds, so that the user may regulate the mass of the barbell 20 weight. The barbell 20 weight also includes a small baffle 23 disposed within the chamber 28 and extending from side to side, the baffle 23 preventing sudden shifts in weight caused by flow of the water A as the bag 22 is lifted. In the preferred embodiment, the bag 22 also has a neoprene cushion 25 fixedly attached to its rear surface.

The barbell 20 is designed for lifting the bag 22 completely off the ground or other surface in normal use. The bag 22 will typically measure about one foot long by nine inches wide by two feet tall when filled with water. The shape of the bag 22 is such that the bag 22 is only slightly flexible when filled with water A, and is not adapted for flexure into curved, angular, oblate, or other shapes, the walls of the bag 22 being made from a material having sufficient memory to assume the same shape described above when filled with water. A suitably thick gauge of vinyl may be adapted to this purpose. The handle 32 will typically be made from 1¼" outside diameter plastic pipe 36 measuring about twenty-two inches in length, the neoprene hand grip 38 being about 3⁄16" thick.

Figure 4:
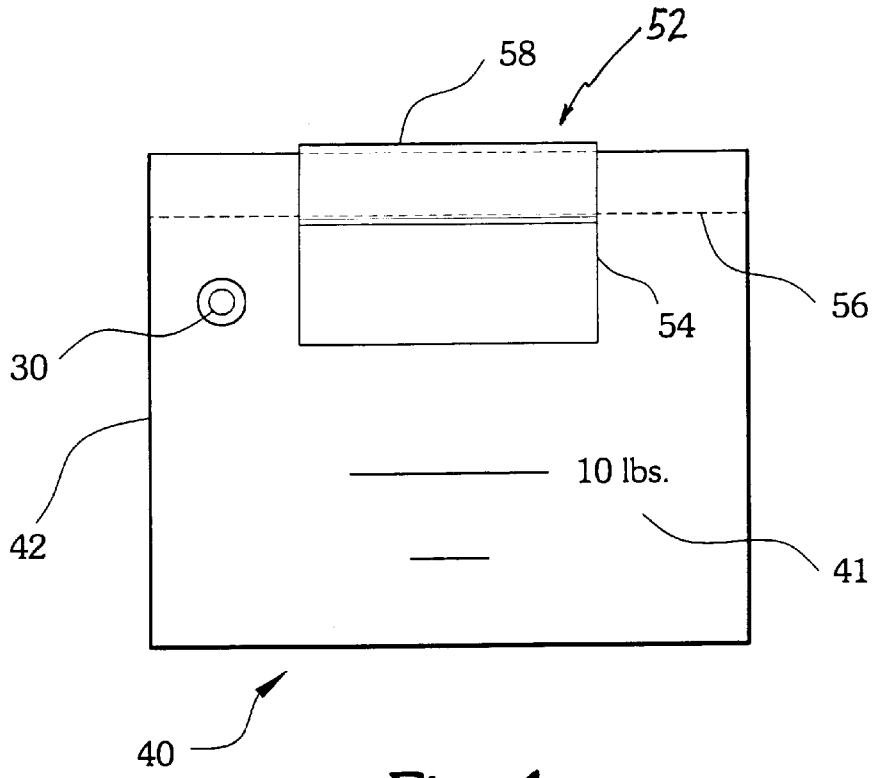
FIG. 4 is a front elevational view of a dumbbell weight of the water weight exercise kit according to the present invention.
Figure 5:
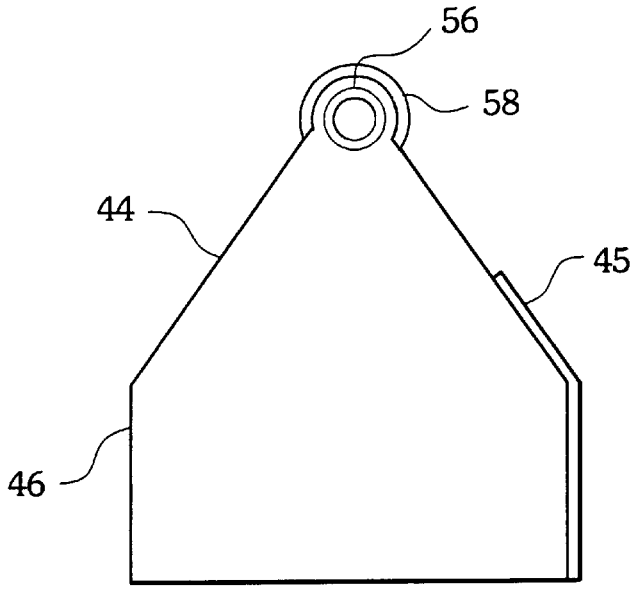
FIG. 5 is a side elevational view of the dumbbell weight of FIG. 4.

As shown in FIGS. 1, 4, and 5, the dumbbell 40 type weight includes a strong, flexible bag 42 or bladder made from a thermoplastic material, such as polypropylene. The bag 42 includes an upper portion 44 and a lower portion 46, the interior of the bag 42 forming an enclosed, water-tight chamber 48 adapted for receiving water through a fill spout 30 disposed on the upper portion 44 of the bag 42. As shown in FIG. 1, when the bag 42 is filled with water A, the lower portion 46 is shaped like a rectangular prism and the upper portion 44 is shaped like a triangular prism so that the bag 42 bears a resemblance to a building having a gable roof as viewed from the side.

The bag 42 includes a cylindrical handle 52 disposed in the upper portion 44, the handle 52 extending across the length of the bag 42 from one side to the other, the longitudinal axis of the cylindrical handle 52 being aligned with the centerline of the bag 42, which extends along the apex of the upper portion 44. The upper portion 44 has a recess 54 defined in its central portion, the recess 54 also having the shape of a triangular prism, the recess 54 permitting the user to grip the handle 52 with one hand disposed about the central portion of the handle 52, the weight being suspended directly below the user's hand.

As shown most clearly in FIGS. 4 and 5, the handle 52 is made from a hollow pipe 56 of plastic material, such as polyvinyl chloride. A hand grip 58 made from neoprene is disposed about the pipe 56. The bag 42 is made from a flexible material, so that when the bag 42 is empty, it may be rolled around the handle 52 for storage. The chamber 48 has the capacity to receive at least ten pounds of water A. In the preferred embodiment, the bag 42 is made from a translucent material and has indicia 41 on its surface calibrating the volume of the chamber 48 in convenient increments, such as every ten pounds, so that the user may regulate the mass of the dumbbell 40 weight. In the preferred embodiment, the bag 42 also has a neoprene cushion 45 fixedly attached to its rear surface.

The dumbbell 40 is adapted for being lifted with one hand, typically measuring about one foot long by nine inches wide by ten inches high when filled with water. The shape of the bag 22 is such that the bag 22 is only slightly flexible when filled with water A, and is not adapted for flexure into curved, angular, oblate, or other shapes, the walls of the bag 22 being made from a material having sufficient memory to assume the same shape described above when filled with water. The handle 52 is about one foot in length, and is also made from 1¼" outside diameter plastic pipe 56 encased in a 3/16" thick neoprene hand grip 58.

Figure 6:
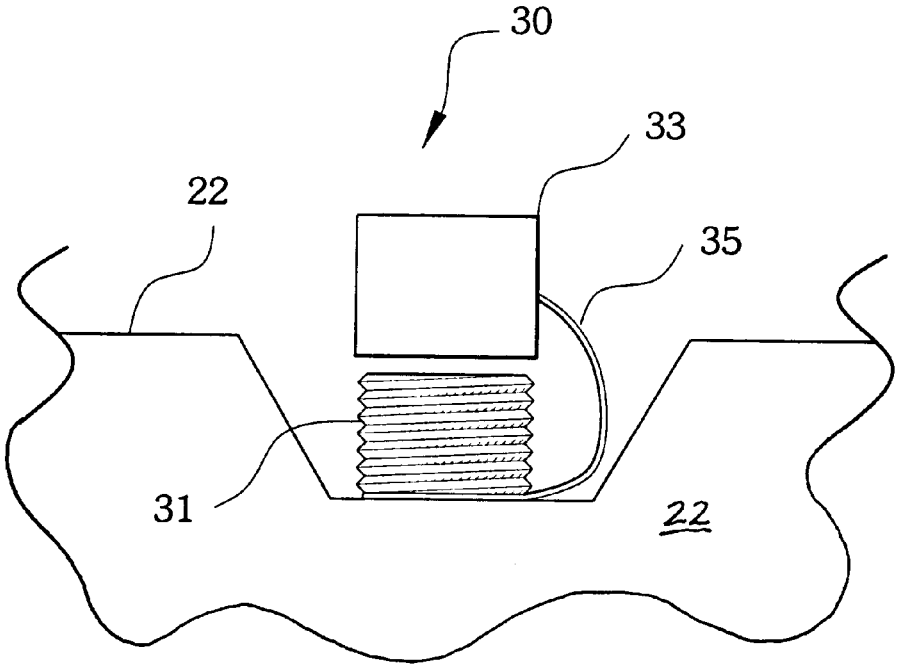
FIG. 6 is a side view of a fill spout of a weight of the water weight exercise kit according to the present invention.

The fill spout 30 used with both the barbell 20 and dumbbell 40 type weights is shown more clearly in FIG. 6. The spout 30 is recessed below the surface of the bag 22 or 42. The spout 30 includes an externally threaded mouth 31, an internally threaded cap 33 adapted for engaging the mouth 31, and a tether 35 securing the cap 33 to the bag 22 or 42 when the cap 33 is unscrewed from the mouth 31. The kit is provided with a funnel 60 for filling the barbell 20 and dumbbell 40 weights with water. The funnel 60 has a clear, flexible, conical spout 62 made from latex and a clear, flexible, plastic hose 64, which may be made from vinyl, for example. The outside diameter of the hose 64 is slightly smaller than the inside diameter of the mouth 31 so that the hose 64 may be inserted in the chamber 28 or 48 to fill the weights 20 and 40, respectively, with water.

The kit 10 also includes a storage pouch 80 for storage and transport of the barbell 20, dumbbell 40 and funnel 60. The storage pouch is made from nylon, and includes a drawstring 82 for closing the mouth of the pouch. The pouch 80 will typically measure about twenty seven inches in length and about one foot in width. When not in use, the weights 20 and 40 may be rolled about their respective handles 32 and 52 and placed in the pouch with the funnel 60.

It is to be understood that the present invention is not limited to the embodiments described above, but encompasses any and all embodiments within the scope of the following claims. It will also be understood that deviations from the preferred dimensions may be made in actual manufacture while still being encompassed within the following claims.

We claim:

1. A water weight exercise kit comprising:

a) a barbell weight, comprising:

(i) a bag made from a flexible and thermoplastic material, the bag forming a water-tight chamber adapted for receiving a volume of water, having an upper portion and a lower portion and having a fill spout disposed in the upper portion;

(ii) a handle being a hollow, cylindrical pipe made from a thermoplastic material and having at least one neoprene hand grip about its circumference, the handle being disposed in the upper portion of said bag, the handle having a first end and a second end; and (iii) wherein said bag is made from a material flexible enough so that said bag may rolled about said handle when empty, and having sufficient memory so that the lower portion of said bag has a rectangular prismatic shape and said upper portion has a triangular prismatic shape when said bag is filled with water; and (iv) wherein the ends of said handle extend laterally from opposite sides of the upper portion of said bag, said barbell weight being adapted for lifting off of a surface by grasping the ends of said handle, the bag being suspended between the ends of said handle;

b) a dumbbell weight, comprising:

(i) a bag made from a flexible and thermoplastic material, the bag forming a water-tight chamber adapted for receiving a volume of water, having an upper portion and a lower portion and having a fill spout disposed in the upper portion;

(ii) a handle being a hollow, cylindrical pipe made from a thermoplastic material and having at least one neoprene hand grip about its circumference, the handle being disposed in the upper portion of said bag, the handle having a first end and a second end; and (iii) wherein said bag is made from a material flexible enough so that said bag may rolled about said handle when empty, and having sufficient memory so that the lower portion of said bag has a rectangular prismatic shape and said upper portion has a triangular prismatic shape when said bag is filled with water; and (iv) wherein the ends of said handle extend from a side of the upper portion of said bag to an opposite side, said dumbbell weight being adapted for lifting off a surface by grasping said handle with one hand, the bag being suspended from said handle;

c) a funnel for filling said barbell weight and said dumbbell weight with water, the funnel having a conically shaped spout and a flexible translucent hose connected to said conically shaped spout; and d) a storage pouch made from a flexible nylon material, having a mouth and having a drawstring for closing the mouth of the pouch, the pouch being adapted to receive and house said barbell weight, said dumbbell weight, and said funnel for storage and transport when said barbell weight and said dumbbell weight are drained of water and rolled around their respective handles.

2. The water weight exercise kit according to claim 1, wherein the fill spout of said barbell weight and the fill spout of said dumbbell weight each further comprise:

a) a mouth recessed in the surface of the bag;

b) a cap adapted for engaging said mouth; and c) a tether attaching said cap to said mouth.

3. The water weight exercise kit according to claim 1, wherein the bag of said barbell weight has the capacity for receiving at least fifty pounds of water.

4. The water weight exercise kit according to claim 3, wherein the bag of said barbell weight is made from a translucent material and wherein the bag of said barbell weight further comprises indicia on the surface of the bag, the indicia being calibrated to indicate the weight of the water enclosed within the chamber at selected water levels.

5. The water weight exercise kit according to claim 3, wherein said barbell weight further comprises a neoprene cushion fixedly attached to a face of the bag.

6. The water weight exercise kit according to claim 3, wherein the bag of said barbell weight has a recess defined in the upper portion of the bag adapted for permitting the user to extend his hand around said handle at the center of said handle in order to lift said barbell weight with a single hand.

7. The water weight exercise kit according to claim 1, wherein the bag of said dumbbell weight has the capacity for receiving at least ten pounds of water.

8. The water weight exercise kit according to claim 7, wherein the bag of said dumbbell weight is made from a translucent material and wherein the bag of said dumbbell weight further comprises indicia on the surface of the bag, the indicia being calibrated to indicate the weight of the water enclosed within the chamber at selected water levels.

9. The water weight exercise kit according to claim 7, wherein said dumbbell weight further comprises a neoprene cushion fixedly attached to a face of the bag.

10. The water weight exercise kit according to claim 7, wherein the bag of said dumbbell weight has a recess defined in the upper portion of the bag adapted for permitting the user to extend his hand around said handle at the center of said handle in order to lift said dumbbell weight with a single hand.

11. A barbell weight, comprising:

a) a bag, the bag being made from a flexible and thermoplastic material, the bag being enclosed in order to form a water-tight chamber adapted for receiving at least fifty pounds of water, having an upper portion and a lower portion and having a fill spout disposed in the upper portion;

b) a handle, the handle being a hollow, cylindrical pipe made from a thermoplastic material and having at least one neoprene hand grip about its circumference, the handle being disposed in the upper portion of said bag, the handle having a first end and a second end; and c) wherein said bag is made from a material flexible enough so that said bag may rolled about said handle when empty, and having sufficient memory so that the lower portion of said bag has a rectangular prism shape and said upper portion has a triangular prism shape when said bag is filled with water;

d) wherein the ends of said handle extend laterally from opposite sides of the upper portion of said bag, said barbell weight being adapted for lifting off of a surface by grasping the ends of said handle, the bag being suspended between the ends of said handle; and e) the bag of said barbell weight has a recess defined in the upper portion of the bag adapted for permitting the user to extend his hand around said handle at the center of said handle in order to lift said barbell weight with a single hand.

12. The barbell weight according to claim 11, wherein the fill spout further comprises:

a) a mouth recessed in the surface of the bag;

b) a cap adapted for engaging said mouth; and c) a tether attaching said cap to said mouth.

13. The barbell weight according to claim 11, wherein the bag of said barbell weight is made from a translucent material and wherein the bag of said barbell weight further comprises indicia on the surface of the bag, the indicia being calibrated to indicate the weight of the water enclosed within the chamber at selected water levels.

14. The barbell weight according to claim 11, wherein said barbell weight further comprises a neoprene cushion fixedly attached to a face of the bag.

15. A dumbbell weight, comprising:

a) a bag, the bag being made from a flexible and thermoplastic material, the bag being enclosed in order to form a water-tight chamber adapted for receiving a volume of water, having an upper portion and a lower portion and having a fill spout disposed in the upper portion;

b) a handle, the handle being a hollow, cylindrical pipe made from a thermoplastic material and having at least one neoprene hand grip about its circumference, the handle being disposed in the upper portion of said bag, the handle having a first end and a second end; and c) wherein said bag is made from a material flexible enough so that said bag may rolled about said handle when empty, and having sufficient memory so that the lower portion of said bag has a rectangular prism shape and said upper portion has a triangular prism shape when said bag is filled with water; and d) wherein the ends of said handle extend from a side of the upper portion of said bag to an opposite side, said dumbbell weight being adapted for lifting off a surface by grasping said handle with one hand, the bag being suspended from said handle.

16. The dumbbell weight according to claim 15, wherein the fill spout of said dumbbell weight further comprises:

a) a mouth recessed in the surface of the bag;

b) a cap adapted for engaging said mouth; and c) a tether attaching said cap to said mouth.

17. The dumbbell weight according to claim 15, wherein the bag of said dumbbell weight has the capacity for receiving at least ten pounds of water.

18. The water weight exercise kit according to claim 17, wherein the bag of said dumbbell weight is made from a translucent material and wherein the bag of said dumbbell weight further comprises indicia on the surface of the bag, the indicia being calibrated to indicate the weight of the water enclosed within the chamber at selected water levels.

19. The water weight exercise kit according to claim 17, wherein said dumbbell weight further comprises a neoprene cushion fixedly attached to a face of the bag.

20. The water weight exercise kit according to claim 17, wherein the bag of said dumbbell weight has a recess defined in the upper portion of the bag adapted for permitting the user to extend his hand around said handle at the center of said handle in order to lift said dumbbell weight with a single hand.

* * * * *